US006170677B1

(12) United States Patent
Meltser

(10) Patent No.: US 6,170,677 B1
(45) Date of Patent: Jan. 9, 2001

(54) STORAGE TRAY FOR PAPERWORK AND THE LIKE

(75) Inventor: Solomon Meltser, Herzliya (IL)

(73) Assignee: Zriha Hlavin Industries Ltd., Mobile Post Ephraim (IL)

( * ) Notice: Under 35 U.S.C. 154(b), the term of this patent shall be extended for 0 days.

(21) Appl. No.: 09/362,845

(22) Filed: Jul. 28, 1999

(51) Int. Cl.[7] ..... B42F 17/12; A47F 3/14
(52) U.S. Cl. ..... 211/55; 211/11; 211/128.1
(58) Field of Search ..... 211/55, 11, 128.1

(56) References Cited

U.S. PATENT DOCUMENTS 5,826,730 * 10/1998 Stravitz ..... 211/55

* cited by examiner

*Primary Examiner*—Daniel P. Stodola
*Assistant Examiner*—Erica B. Harris

(74) *Attorney, Agent, or Firm*—Abelman, Frayne & Schwab

(57) ABSTRACT

A storage tray for paperwork and the like, including a pair of side elements, each side element including a first tray support surface and a second tray support surface generally perpendicular to each other, and a plurality of dividers, each divider including a first paper support surface and a second paper support surface extending generally perpendicularly from the first paper support surface, each first paper support surface being attached at opposite side edges thereof to the side elements, and each second paper support surface being attached to an adjacent divider, the tray being supportable on the first tray support surface wherein the first paper support surfaces are generally vertical and the second paper support surfaces are generally horizontal and adapted to support edges of paper sheets thereupon, and the tray being supportable on the second tray surface wherein the second paper support surfaces are generally vertical and the first paper support surfaces are generally horizontal and adapted to support planar surfaces of paper sheets thereupon.

8 Claims, 5 Drawing Sheets

STORAGE TRAY FOR PAPERWORK AND THE LIKE

FIELD OF THE INVENTION

The present invention relates generally to storage trays for paperwork and the like.

BACKGROUND OF THE INVENTION

Storage trays for holding papers, bills, scrap paper, documents, stationery and the like are very well known. These kinds of storage trays may be classified into two general styles: papers sit vertically in the tray, or papers lay horizontally in the tray. Horizontal trays are generally preferred when it is important to avoid bends or creases in papers, such as raised letterhead stationery, or relatively large sized papers, such as DIN size A3 paper. Vertical trays are generally preferred when it is desired that the storage tray should occupy as little space as possible on a desk.

Horizontal trays are configured to sit horizontally on a desk or other support surface, and cannot generally be converted into a tray for vertical storage of papers, without awkwardly propping or otherwise supporting the tray in the vertical position. The converse is also true for vertical trays which cannot conveniently be converted into horizontal trays without the papers falling out of the tray, for example.

SUMMARY OF THE INVENTION

The present invention seeks to provide a novel storage tray for holding paperwork and the like, which unlike the prior art, can be used for vertical or horizontal storage of papers as desired. The tray can also be mounted on a wall, for example. The tray has a modular construction with adjustable dividers. One tray can be attached to another tray to form a bigger tray. The tray may be supplied in kit-form for assembly by a customer.

There is thus provided in accordance with a preferred embodiment of the present invention a storage tray for paperwork and the like, including a pair of side elements, each side element including a first tray support surface and a second tray support surface generally perpendicular to each other, and a plurality of dividers, each divider including a first paper support surface and a second paper support surface extending generally perpendicularly from the first paper support surface, each first paper support surface being attached at opposite side edges thereof to the side elements, and each second paper support surface being attached to an adjacent divider, the tray being supportable on the first tray support surface wherein the first paper support surfaces are generally vertical and the second paper support surfaces are generally horizontal and adapted to support edges of paper sheets thereupon, and the tray being supportable on the second tray support surface wherein the second paper support surfaces are generally vertical and the first paper support surfaces are generally horizontal and adapted to support planar surfaces of paper sheets thereupon.

In accordance with a preferred embodiment of the present invention the side elements are formed with a plurality of apertures and the first paper support surfaces are formed with a plurality of tongues, each tongue being adapted to fit through a corresponding one of the apertures, and the tray further includes a fastener which secures the tongue against the side element.

Further in accordance with a preferred embodiment of the present invention the fastener includes a flexible booty which removably and snugly fits over the tongue and generally abuts against the side element.

Still further in accordance with a preferred embodiment of the present invention at least one first support foot extends from the first tray support surface, and at least one second support foot extends from the second tray support surface. Preferably the support feet include flexible booties which removably and snugly fit over protrusions formed in the side elements.

In accordance with a preferred embodiment of the present invention the dividers are each formed with a plurality of grooves on a surface of the divider generally opposite to the first paper support surface, and the second paper support surface is attached to an adjacent divider by an edge of the second paper support surface being snugly received in one of the grooves.

Further in accordance with a preferred embodiment of the present invention the dividers and/or the side elements are formed with mating fasteners which fasten two of the trays together.

Still further in accordance with a preferred embodiment of the present invention the dividers and/or the side elements are formed with a see-through cutout.

In accordance with a preferred embodiment of the present invention at least one of the dividers is formed with wall-mounting structure for mounting the tray on a wall.

BRIEF DESCRIPTION OF THE DRAWINGS

The present invention will be understood and appreciated more fully from the following detailed description, taken in conjunction with the drawings in which.

DETAILED DESCRIPTION OF A PREFERRED EMBODIMENT

Figure 1B:
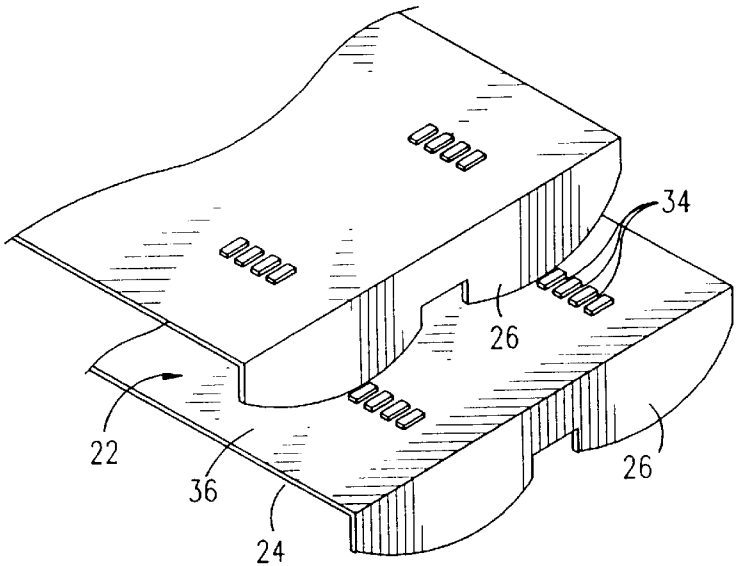
FIG. 1B is a simplified pictorial illustration of a rear portion of the storage tray of FIG. 1A.

Reference is now made to FIGS. 1A, 1B, 2 and 3 which illustrate a storage tray 10 constructed and operative in accordance with a preferred embodiment of the present invention.

Tray 10 preferably includes a pair of side elements 12. Each side element 12 includes a first tray support surface 14 and a second tray support surface 16 generally perpendicular to each other. One or more first support feet 18 preferably extend from first tray support surface 14, and one or more second support feet 20 preferably extend from second tray support surface 16.

Any convenient number of dividers 22 are preferably provided, not necessarily each having the same shape or size. Each divider 22 includes a first paper support surface 24 and a second paper support surface 26 extending generally perpendicularly from the first paper support surface 24. Each first paper support surface 24 is preferably attached at opposite side edges thereof to side elements 12. This is preferably accomplished by forming side elements 12 with a plurality of apertures 28 and first paper support surfaces 24 with a plurality of tongues 30. Each tongue 30 is adapted to fit through a corresponding one of the apertures 28. A fastener 32 secures each tongue 30 against side element 12. A preferred fastener 32 is a flexible booty, such as one made of an elastomer, which removably and snugly fits over tongue 30 and generally abuts against side element 12.

Similarly, first 18 and second 20 support feet may include flexible booties which removably and snugly fit over protrusions or tongues 33 formed in side elements 12.

Each second paper support surface 26 is preferably attached to an adjacent divider 22. This is preferably accomplished by forming dividers 22 with a plurality of grooves 34 on a surface 36 of the divider 22 generally opposite to first paper support surface 24. Second paper support surface 26 is then attached to an adjacent divider by an edge of the second paper support surface 26 being snugly received in one of grooves 34.

The dividers 22 and/or the side elements 12 may be formed with one or more see-through cutouts 38. Tray 10 is preferably formed of a suitable sturdy plastic, and may be transparent, translucent or opaque, and can be manufactured in a variety of colors, shapes and sizes.

Figure 1A:
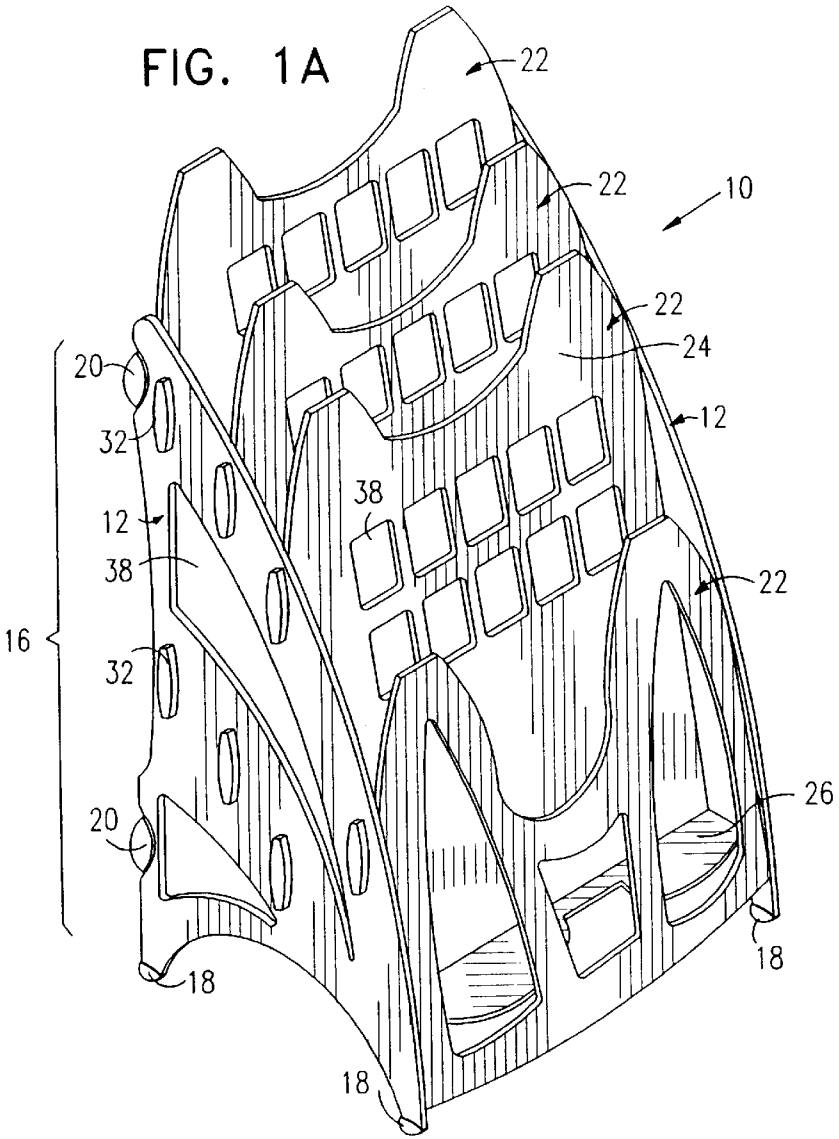
FIG. 1A is a simplified pictorial illustration of a storage tray constructed and operative in accordance with a preferred embodiment of the present invention, in a vertical position.

As seen in FIG. 1A, tray 10 can be supported on first tray surface 14, wherein first paper support surfaces 24 are generally vertical and second paper support surfaces 26 are generally horizontal and adapted to support edges of paper sheets thereupon.

Figure 2:
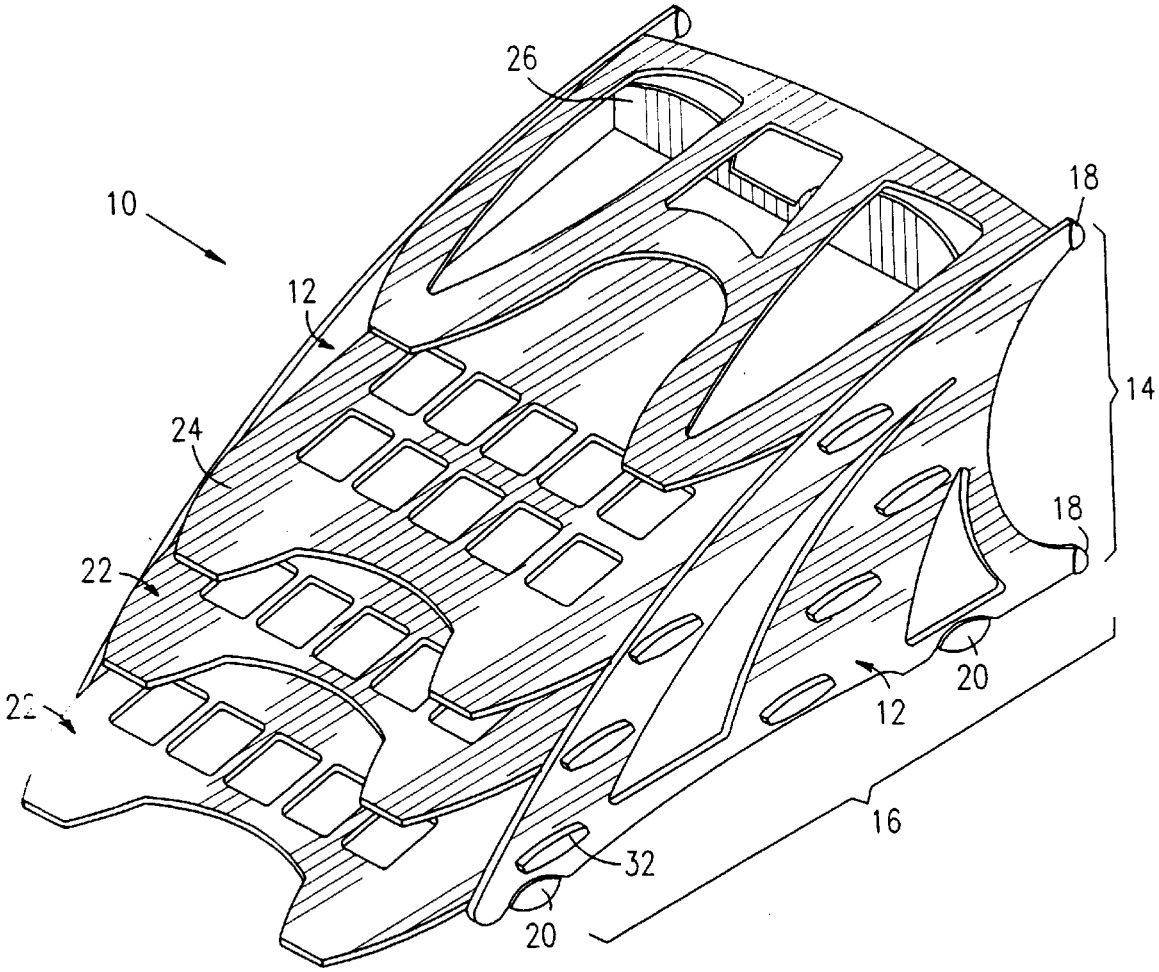
FIG. 2 is a simplified pictorial illustration of the storage tray of FIG. 1A in a horizontal position.
Figure 3:
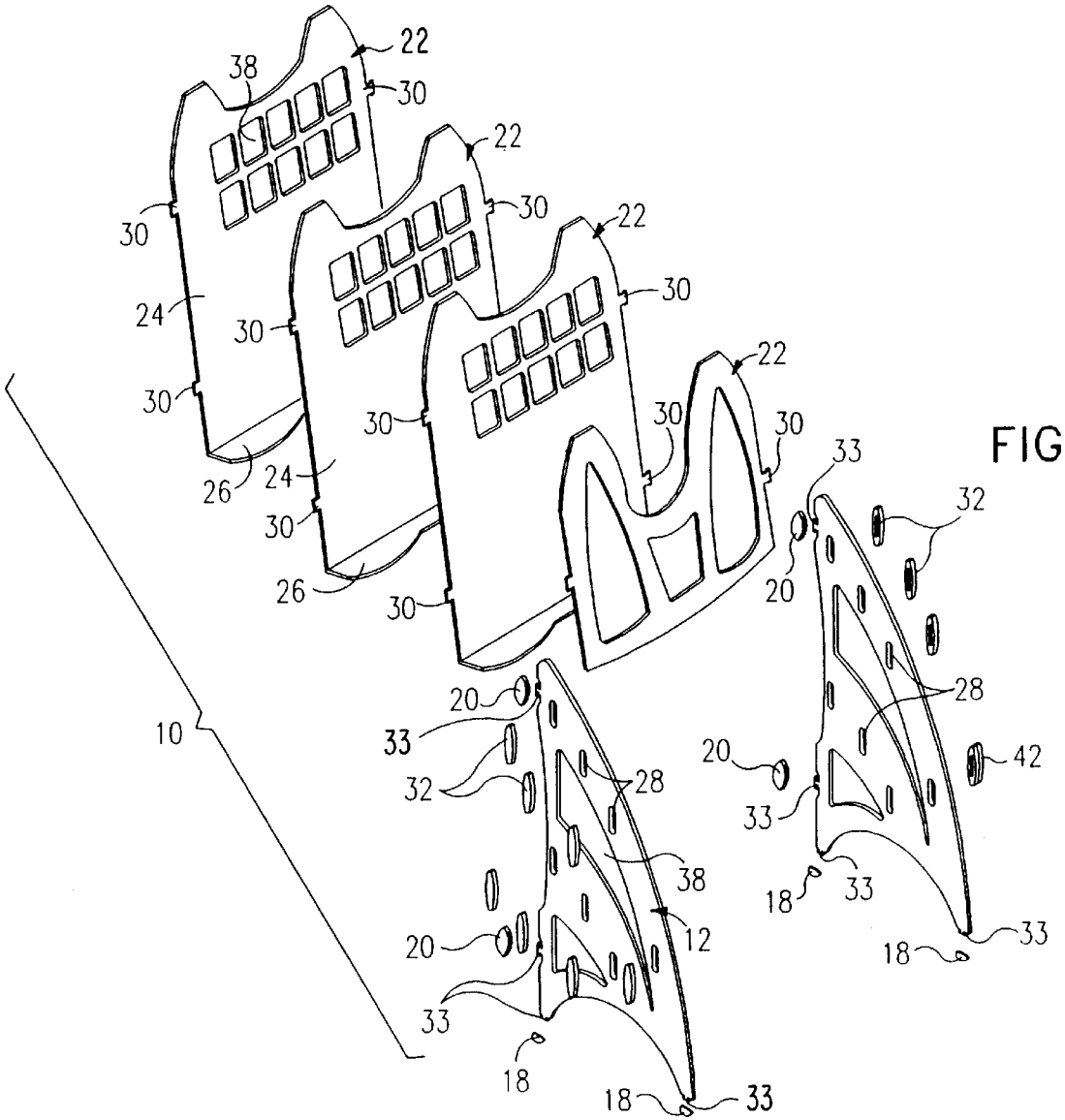
FIG. 3 is a simplified exploded illustration of the storage tray of FIG. 1A.

As seen in FIG. 2, tray 10 can be supported on second tray surface 16 wherein second paper support surfaces 26 are generally vertical and first paper support surfaces 24 are generally horizontal and adapted to support planar surfaces of paper sheets thereupon.

Figure 4:
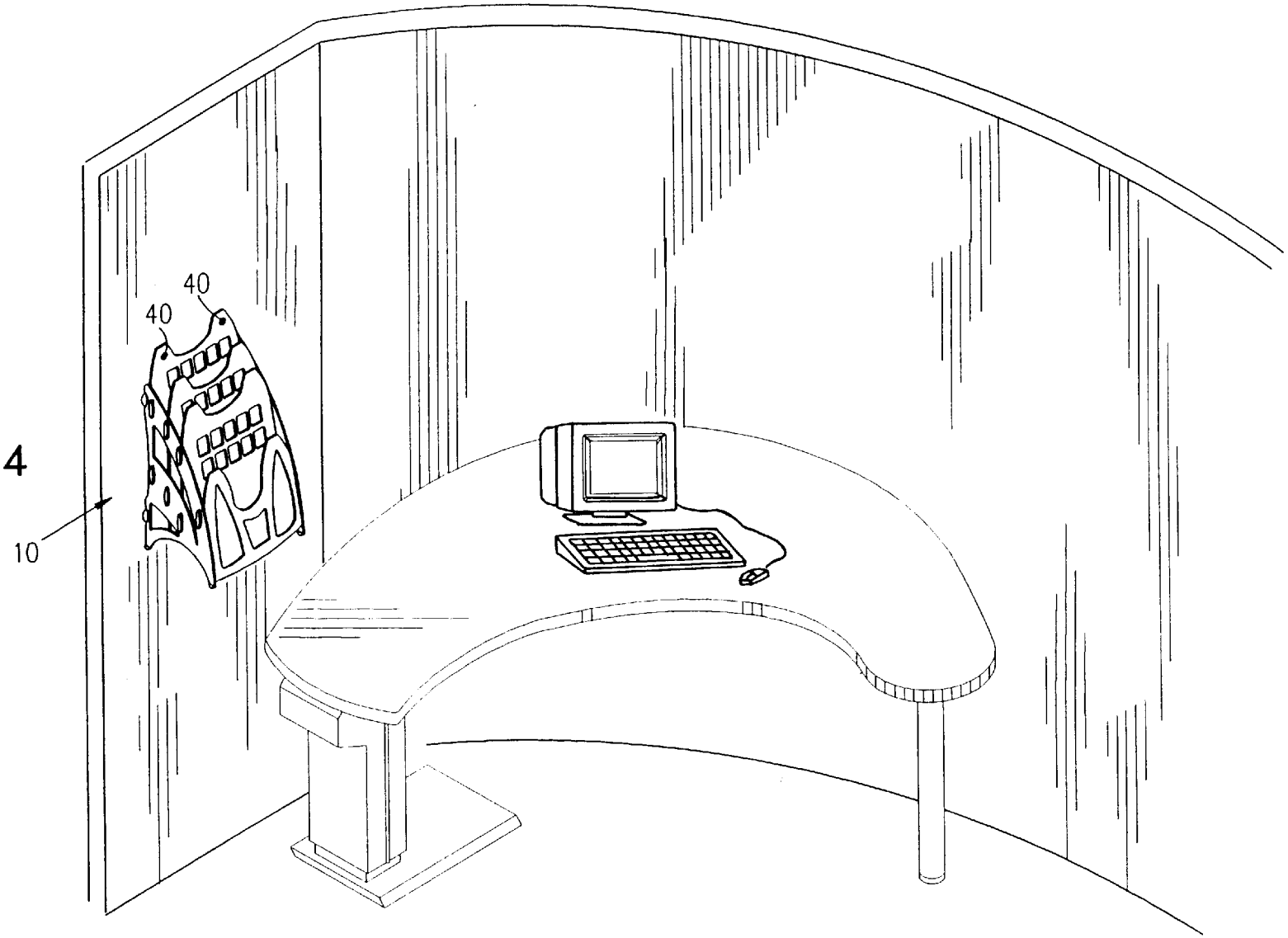
FIG. 4 is a simplified pictorial illustration of the storage tray of FIG. 1A mounted on a wall.

Reference is now made to FIG. 4 which shows that storage tray 10 may be mounted on a wall. In such an embodiment, at least one of the dividers 22 is formed with wall-mounting structure, such as mounting holes 40, for mounting tray 10 on the wall.

Figure 5:
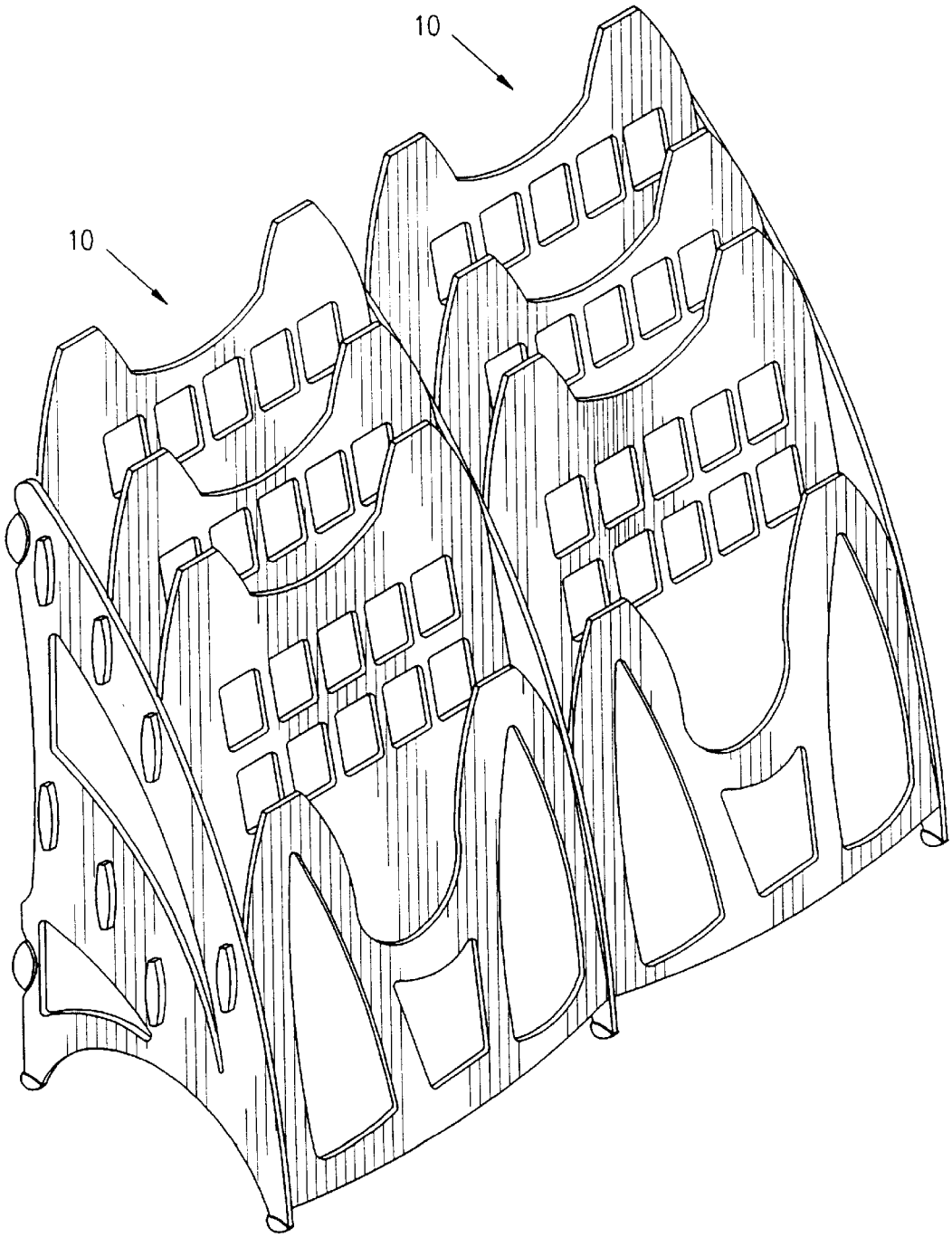
FIG. 5 is a simplified pictorial illustration of a pair of the storage trays of FIG. 1A connected together in accordance with a preferred embodiment of the present invention.

Reference is now made to FIG. 5 which illustrates a pair of trays 10 connected together in accordance with a preferred embodiment of the present invention. Dividers 22 and/or side elements 12 are preferably formed with mating fasteners which fasten two of the trays 10 together. An example of a mating fastener is shown in the lower right portion of FIG. 3, which illustrates a double flexible booty 42 which can be snugly fit on both sides thereof to tongues 30 of abutting first paper support surfaces 24. It is appreciated by persons skilled in the art, that this is just one example of many kinds of fasteners for attaching the trays 10 together. In this manner, the trays 10 can be fastened in modular fashion to form any combination of trays.

It will be appreciated by persons skilled in the art that the present invention is not limited by what has been particularly shown and described hereinabove. Rather the scope of the present invention includes both combinations and subcombinations of the features described hereinabove as well as modifications and variations thereof which would occur to a person of skill in the art upon reading the foregoing description and which are not in the prior art.

What is claimed is:

1. A storage tray for paperwork, comprising:

a pair of side elements, each side element comprising a first tray support surface and a second tray support surface generally perpendicular to each other; and a plurality of dividers, each divider comprising a first paper support surface and a second paper support surface extending generally perpendicularly from the first paper support surface, each first paper support surface being attached at opposite side edges thereof to said side elements, and each second paper support surface being attached to an adjacent divider;

wherein said dividers are each formed with a plurality of grooves on a surface of the divider generally opposite to said first paper support surface, and said second paper support surface is attached to an adjacent divider by an edge of said second paper support surface being snugly received in one of said grooves;

said tray being supportable on said first tray support surface wherein said first paper support surfaces are generally vertical and said second paper support surfaces are generally horizontal and adapted to support edges of paper sheets thereupon, and said tray being supportable on said second tray support surface wherein said second paper support surfaces are generally vertical and said first paper support surfaces are generally horizontal and adapted to support planar surfaces of paper sheets thereupon.

2. The storage tray according to claim 1 wherein at least one of said dividers and said side elements are formed with mating fasteners which fasten two of said trays together.

3. The storage tray according to claim 1 wherein at least one of said dividers and said side elements are formed with a see-through cutout.

4. The storage tray according to claim 1 wherein at least one of said dividers is formed with wall-mounting structure for mounting said tray on a wall.

5. The storage tray according to claim 1 wherein said side elements are formed with a plurality of apertures and said first paper support surfaces are formed with a plurality of tongues, each tongue being adapted to fit through a corresponding one of said apertures, and said tray further comprises a fastener which secures said tongue against said side element.

6. The storage tray according to claim 5 wherein said fastener comprises a flexible booty which removably and snugly fits over said tongue and generally abuts against said side element.

7. The storage tray according to claim 1 further comprising at least one first support foot extending from said first tray support surface, and at least one second support foot extending from said second tray support surface.

8. The storage tray according to claim 7 wherein said at least one first and second support feet comprise flexible booties which removably and snugly fit over protrusions formed in said side elements.

* * * * *